US009926758B1

(12) United States Patent
Adkins et al.

(10) Patent No.: US 9,926,758 B1
(45) Date of Patent: Mar. 27, 2018

(54) SYSTEMS AND METHODS FOR REMOVING COMPONENTS OF A SUBSEA WELL

(71) Applicant: Chevron U.S.A. Inc., San Ramon, CA (US)

(72) Inventors: Jimmie Dean Adkins, San Ramon, CA (US); Dana Earl Witt, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 12 days.

(21) Appl. No.: 15/363,546

(22) Filed: Nov. 29, 2016

(51) Int. Cl.

| | |
|---|---|
| ***E21B 29/12*** | (2006.01) |
| ***E21B 19/00*** | (2006.01) |
| *E21B 33/035* | (2006.01) |
| *E21B 19/22* | (2006.01) |

(52) U.S. Cl.
CPC ..... *E21B 29/12* (2013.01); *E21B 19/002* (2013.01); *E21B 19/22* (2013.01); *E21B 33/035* (2013.01)

(58) Field of Classification Search
CPC ..... E21B 29/12; E21B 19/002; E21B 19/22; E21B 33/035
See application file for complete search history.

(56) References Cited

U.S. PATENT DOCUMENTS

| | | | | |
|---|---|---|---|---|
| 6,330,919 | B1 * | 12/2001 | McGarian | E21B 33/035 166/298 |
| 6,629,565 | B2 * | 10/2003 | Harrell | E21B 29/005 166/178 |
| 7,090,019 | B2 * | 8/2006 | Barrow | E21B 29/005 166/298 |
| 8,662,182 | B2 * | 3/2014 | Redlinger | E21B 29/005 166/297 |
| 8,839,864 | B2 | 9/2014 | Beynon | |
| 8,912,806 | B2 | 12/2014 | Banks et al. | |
| 8,955,597 | B2 | 2/2015 | Connell et al. | |
| 9,089,928 | B2 | 7/2015 | Zediker et al. | |
| 9,222,328 | B2 * | 12/2015 | Stokes | E21B 23/006 |
| 2002/0023755 | A1 | 2/2002 | McGarian | |
| 2012/0074110 | A1 | 3/2012 | Zediker et al. | |

(Continued)

FOREIGN PATENT DOCUMENTS

| | | |
|---|---|---|
| AU | 2008293123 B2 | 3/2009 |
| WO | 2010/065994 A1 | 6/2010 |

(Continued)

*Primary Examiner* — Matthew R Buck
*Assistant Examiner* — Aaron L Lembo
(74) *Attorney, Agent, or Firm* — Karen R. DiDomenicis

(57) ABSTRACT

Disclosed are systems and methods for removing components of a subsea well having a wellhead located on a seabed and multiple well casings connected to the wellhead and penetrating the seabed. A cutting tool is lowered from a floating vessel to a predetermined cut location in the subsea well. The cutting tool is at the end of a utility line connected to an actuator located on the floating vessel. The cutting tool is used to sever the multiple well casings at the predetermined cut location such that the multiple well casings are completely severed concurrently. The wellhead and the severed multiple well casings are raised together from the seabed to the floating vessel as a single assembly. Various forms of the cutting tool are disclosed. The methods disclosed can include an integrated procedure for dispensing cement to plug the well at the seabed as the well components are being removed.

36 Claims, 15 Drawing Sheets

(56) References Cited

U.S. PATENT DOCUMENTS

| | | | | |
|---|---|---|---|---|
| 2012/0273470 | A1* | 11/2012 | Zediker ..... | B23K 26/142<br>219/121.61 |
| 2013/0319984 | A1 | 12/2013 | Linyaev et al. | |
| 2014/0090846 | A1 | 4/2014 | Deutch et al. | |
| 2015/0321290 | A1 | 11/2015 | Zediker et al. | |

FOREIGN PATENT DOCUMENTS

| | | | |
|---|---|---|---|
| WO | 2013/019959 | A2 | 2/2013 |
| WO | 2015/088553 | A1 | 6/2015 |

* cited by examiner

SYSTEMS AND METHODS FOR REMOVING COMPONENTS OF A SUBSEA WELL

FIELD

The present disclosure relates to systems and methods for removing components of a subsea well, particularly methods included in the abandonment of a subsea well including a wellhead, a surface conductor and multiple downhole casing strings.

BACKGROUND

Conventional practices used in the abandonment of a subsea hydrocarbon producing, injection or disposal wells include cutting and removing individual portions or components of the subsea well in separate pieces. This is illustrated in FIGS. 1A-1F. FIG. 1A illustrates a subsea well 4 connected to a topsides rig 2, which can be a floating drilling or intervention vessel, by way of a marine riser 28 also referred to simply as a riser 28. A subsea well 4 generally includes a structural casing or conductor $\mathbf{18}_o$, a surface casing $\mathbf{18}_{o-1}$ and multiple concentric casings 18 located downhole, below the wellhead assembly 8 on, at or near the seabed 1, as well as associated components including hangers and seal assemblies (not shown) and other well components. The subsea wellhead assembly 8 typically includes a low-pressure wellhead housing 8A attached to the structural conductor $\mathbf{18}_o$ which is the outermost of the casings 18, and a high-pressure wellhead housing 8B attached to the surface casing $\mathbf{18}_{o-1}$ which is the next outermost of the casings 18, and a blowout preventer (BOP) stack 9. As shown in FIG. 1B, a drill pipe 7 having a conventional cutter 3, which may be equipped with a spear assembly 22, near the end of the drill pipe 7 is used to cut individual well casings 18. Current casing cutter technology is limited in terms of the depth, radius and thickness of cuts that are possible. Currently, with the exception of the two outermost casings ($\mathbf{18}_o$ and $\mathbf{18}_{o-1}$), no more than one well casing 18 can be cut at a time, which in some cases is due to cutting tool 3 dimensional limitations. Therefore each inner casing 18 must be individually cut and retrieved from the subsea well 4 to the floating drilling or intervention vessel 2 at the surface of the water 11. Multiple drill string trips or instances of running the drill pipe 7 and cutter 3 into and out of the well 4 are required to remove each of the individual well casings 18 and components separately as shown in FIGS. 1B-1F. The inner casing strings 18 are cut and retrieved separately. For one, cutting tool 3 dimensions, clearances and cutting arm lengths restrict the depth of cuts possible on inner casings 18. Additionally, the presence of casing hanger seals dictates that the seals be removed separately so that the innermost casing $\mathbf{18}_i$ can be cut and retrieved before cutting the next casing string $\mathbf{18}_{i+1}$. As shown in FIG. 1C, after the innermost casing $\mathbf{18}_i$ is removed, cement can be delivered to the well to form a plug 34. This process is repeated for all of the inner casing strings 18 as shown in FIG. 1D. As shown in FIG. 1E, after all of the inner casing strings 18 have been cut and recovered and only the two outermost casings ($\mathbf{18}_o$ and $\mathbf{18}_{o-1}$) and the well head assembly 8 remain, the BOPs 9 and the riser 28 are recovered to the surface and stored on the rig 2. At this point, as shown in FIG. 1F, only the two outermost casings, the structural casing $\mathbf{18}_o$ and the surface casing $\mathbf{18}_{o-1}$ remain. The large diameter inside the surface casing surface casing $\mathbf{18}_{o-1}$ provides enough clearance dimensionally for longer blades to be used which can cut through both the structural casing $\mathbf{18}_o$ and the surface casing $\mathbf{18}_{o-1}$ at one time. The two principal components of the wellhead assembly 8, the low pressure well head housing 8A and the high pressure wellhead housing 8B, are locked together at this point and must be recovered as a single unit. Cement is introduced into the well 4 following the removal of each casing 18 to form plugs 34. FIG. 1G illustrates the resultant abandoned well 4.

Conventional practices involving the multiple drill string trips required to remove each of the individual well casings 18 and components separately are time-consuming and costly. The multiple lowering and raising of the drill pipe 7 and cutter 3, and multiple trips with the spear assembly 22 also create greater potential for safety incidents, equipment downtime and weather delays.

An improved process for subsea well abandonment, subsea wellhead recovery and/or subsea well plugging that avoids the aforementioned problems would be desirable.

SUMMARY

In one aspect, a method is provided for removing components of a subsea well having a wellhead located at or on a seabed and multiple well casings connected to the wellhead and penetrating the seabed. The method includes lowering a utility line through the water column from a floating vessel. The utility line has an upper end connected to an actuator on the floating vessel and a lower end connected to a cutting tool. The utility line is lowered until the cutting tool is positioned inside the subsea well at a predetermined cut location. The cutting tool is used to sever the multiple well casings at the predetermined cut location such that the multiple well casings are completely severed concurrently. The utility line and the cutting tool are retrieved to the floating vessel. The wellhead and the severed multiple well casings are raised together from the seabed to the floating vessel as a single assembly.

In another aspect, the wellhead and the severed multiple well casings are raised out of the seabed to a predetermined height above the seabed at the well location as a single assembly, and meanwhile a cement dispensing line connected to a cement source on the floating vessel is lowered until the lower end of the cement dispensing line is positioned at the subsea well location above the abandoned subsea well casing strings. Cement is dispensed through the cement dispensing line sufficiently to form a cement plug in the abandoned subsea well casing strings and above the seabed, proximate the subsea well location. The cement dispensing line is then retrieved to the floating vessel, and the wellhead and the severed multiple well casings are raised together from the predetermined height above the subsea well location to the floating vessel as a single assembly.

In yet another aspect, a system is provided for removing components of a subsea well having a wellhead located at or on a seabed and multiple well casings connected to the wellhead and penetrating the seabed. The system includes a floating vessel and a cutting mechanism deployable from the floating vessel. The cutting mechanism includes an actuator located on the floating vessel, a utility line having an upper end connected to the actuator and a lower end, and a cutting tool capable of cutting the multiple well casings. The cutting tool is connected to the lower end of the utility line. The utility line and cutting tool are capable of being lowered from the floating vessel until the cutting tool is positioned at a predetermined cut location in the subsea well.

BRIEF DESCRIPTION OF THE DRAWINGS

These and other objects, features and advantages of the present invention will become better understood with reference to the following description, appended claims and accompanying drawings. The drawings are not considered limiting of the scope of the appended claims. The elements shown in the drawings are not necessarily to scale. Reference numerals designate like or corresponding, but not necessarily identical, elements.

DETAILED DESCRIPTION

Figure 1A:
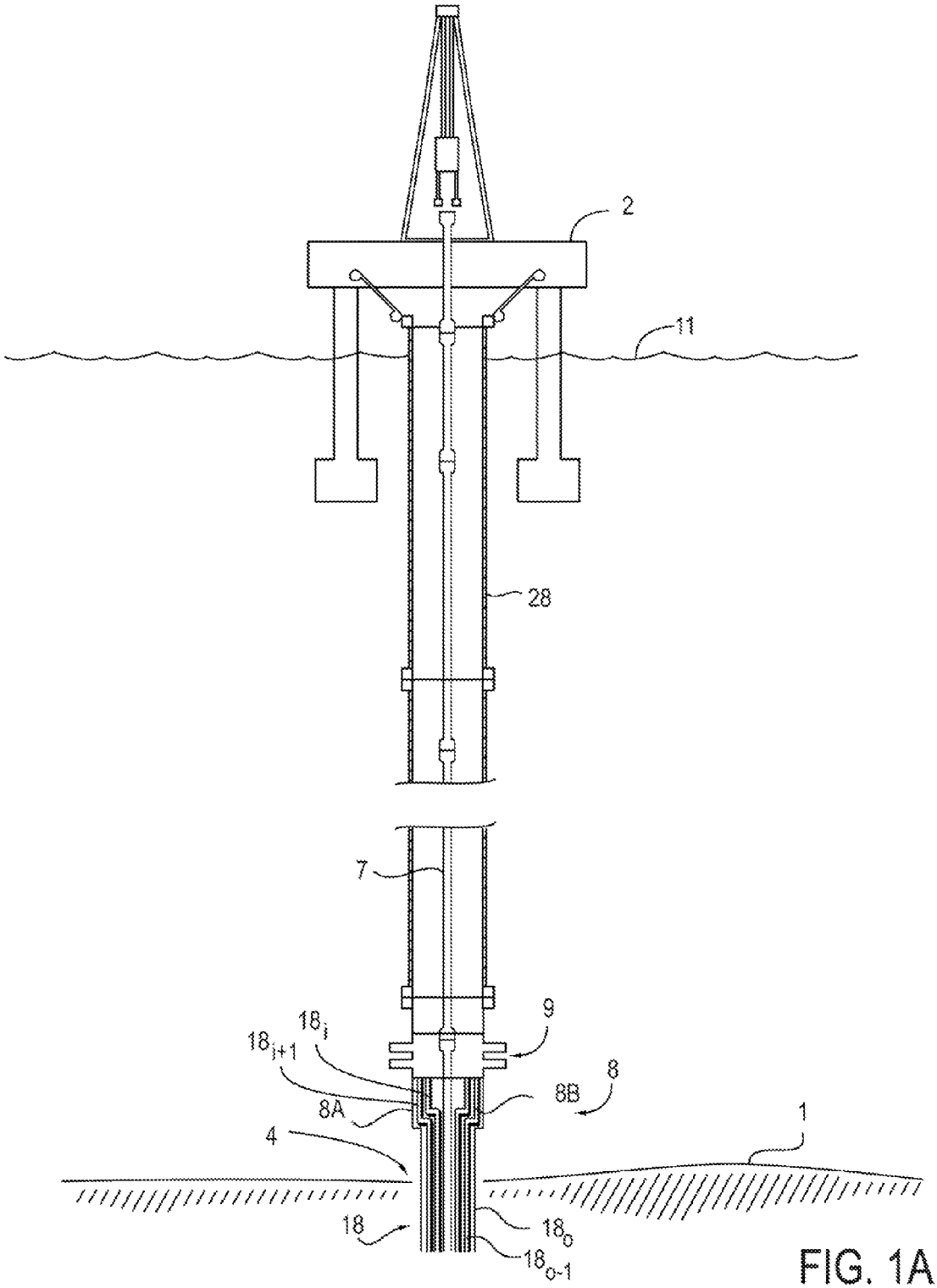
FIG. 1A (Prior Art)
FIGS. 1A-1G illustrate a system and sequence of steps for removing well components according to the prior art.
Figure 1B:
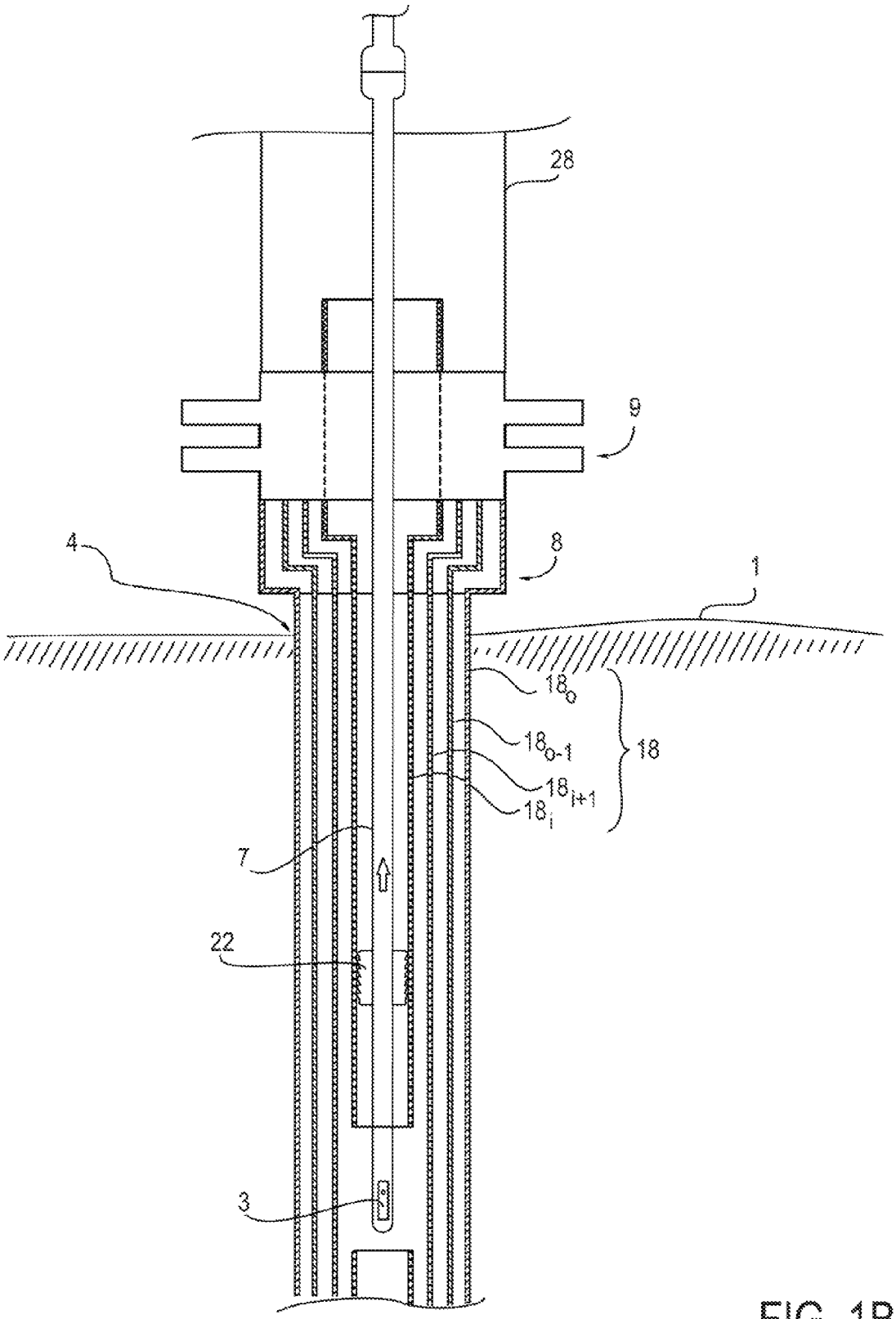
FIG. 1B (Prior Art)
Figure 1C:
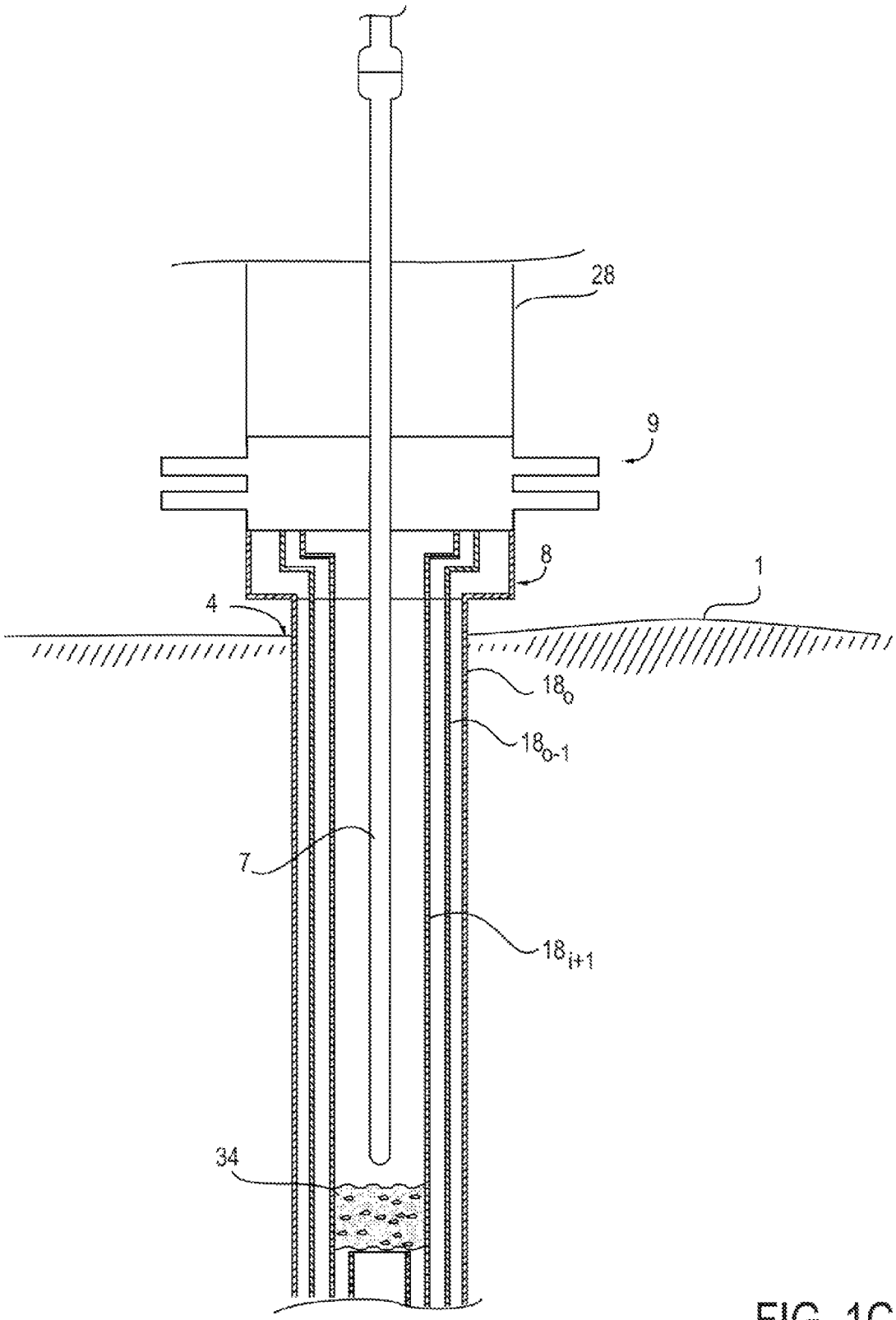
FIG. 1C (Prior Art)
Figure 1D:
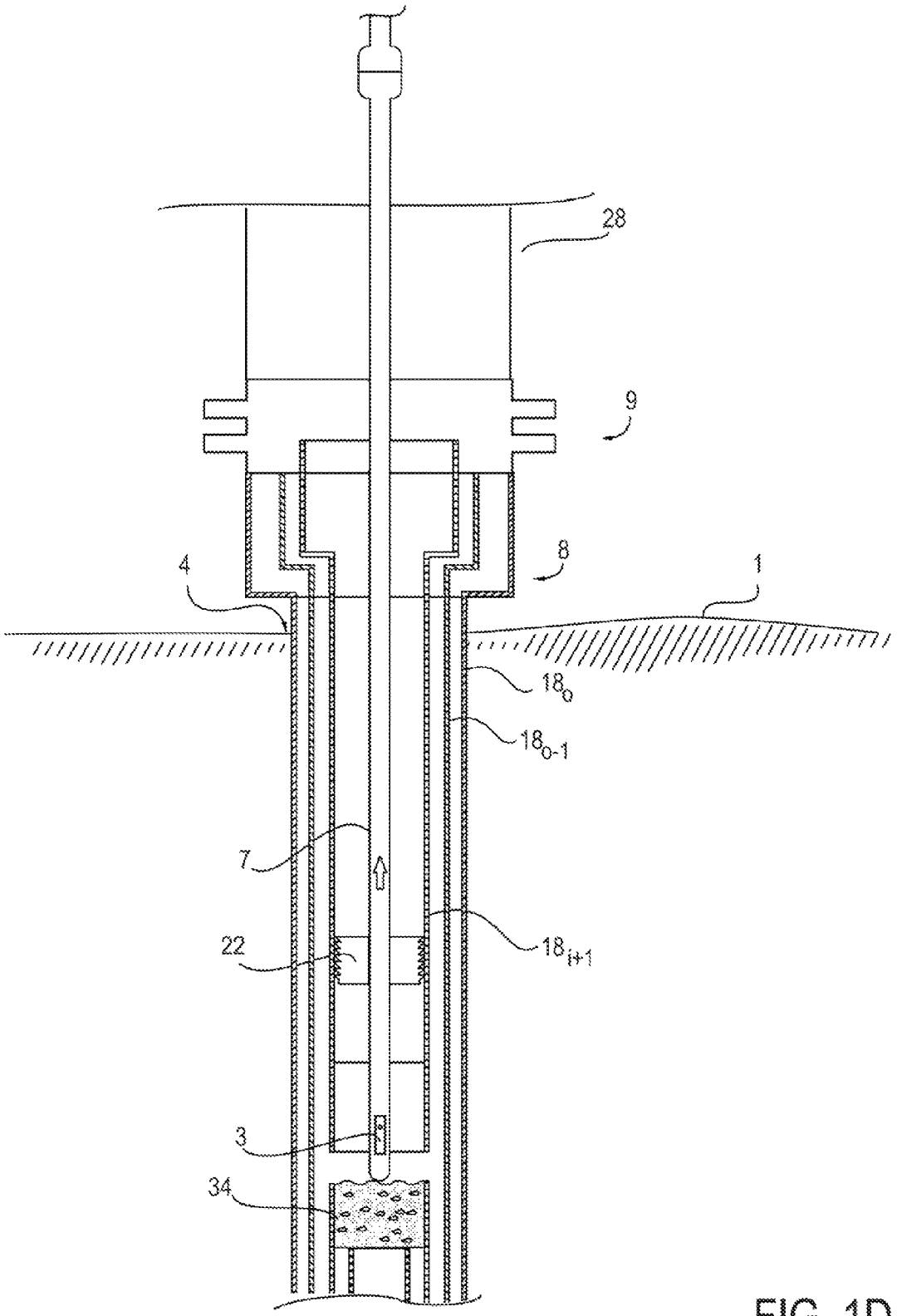
FIG. 1D (Prior Art)
Figure 1E:
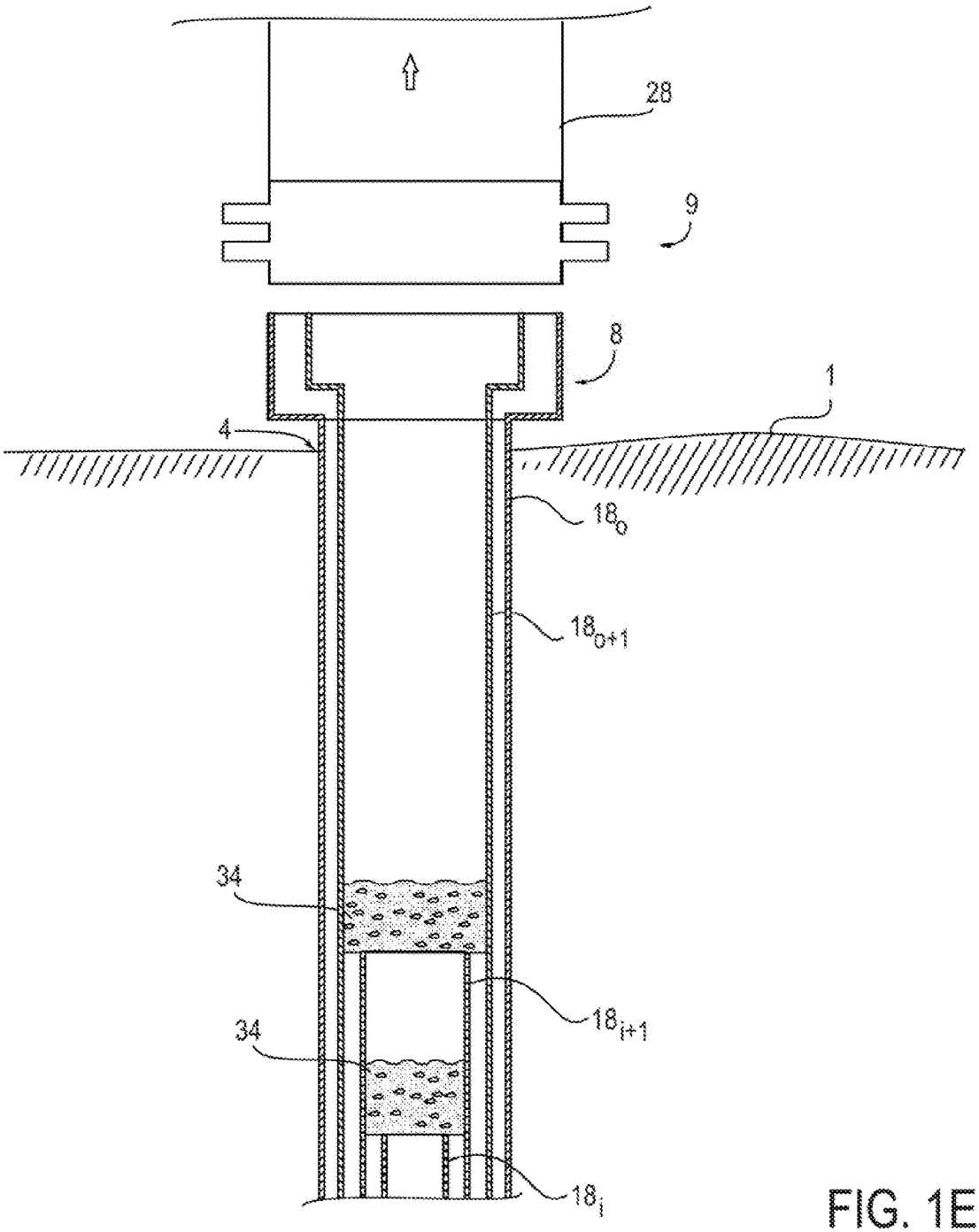
FIG. 1E (Prior Art)
Figure 1F:
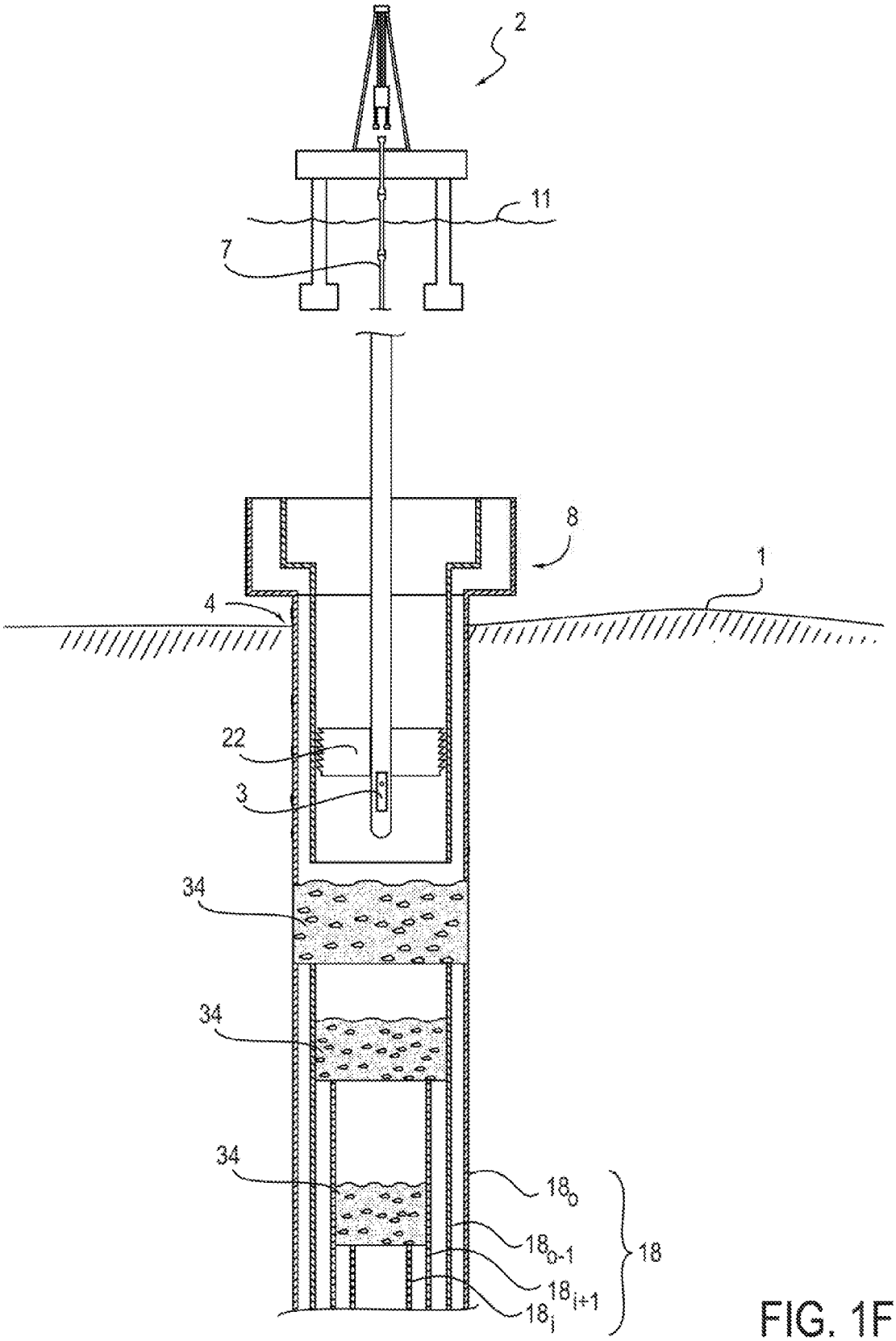
Figure 1G:
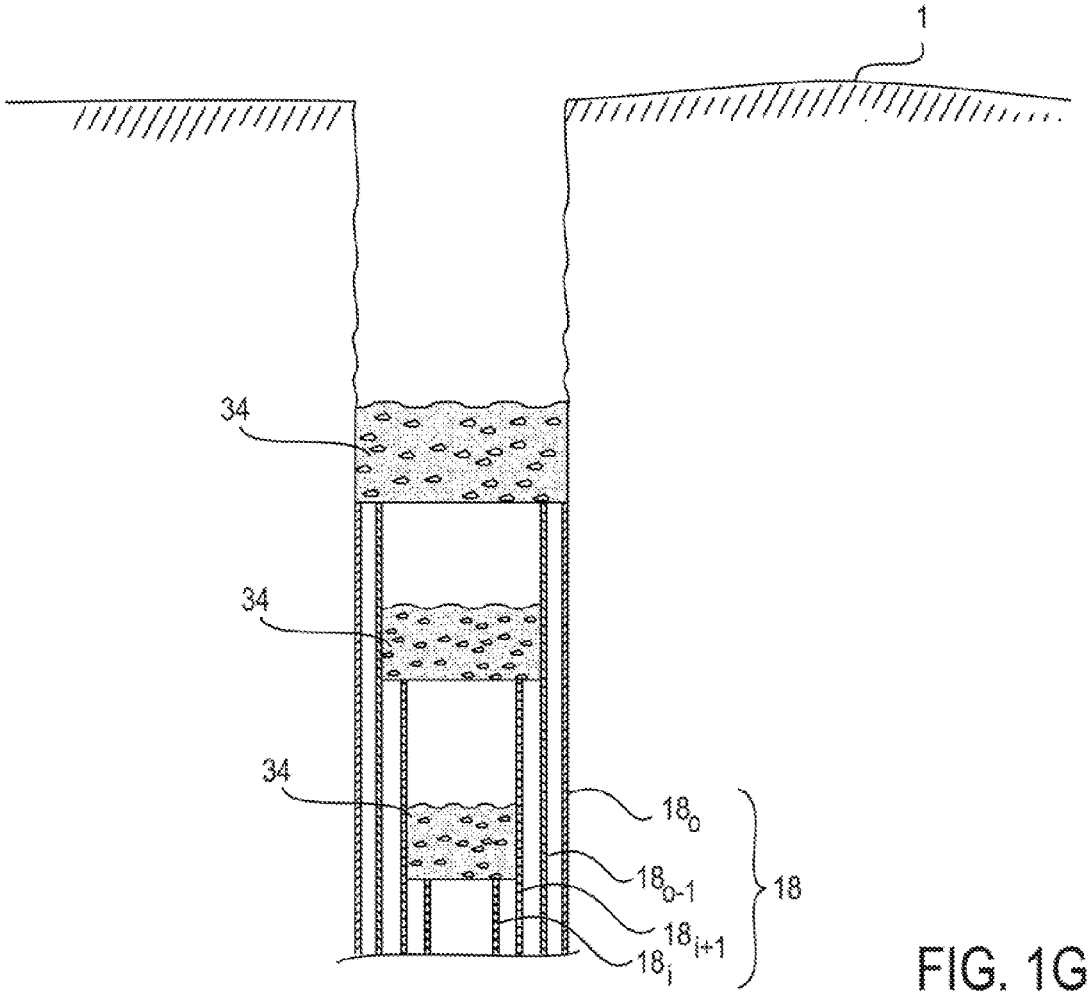
FIG. 1G (Prior Art)

Once a subsea well 4 is decommissioned and plugged, typically with cement or resin (referred to interchangeably as "cement"), it may be required to abandon the well by removal of the wells components on and below the seabed surface 1. This involves removing the casing strings 18, the surface conductor $\mathbf{18}_o$ and the wellhead 8, as well as optional additional equipment connected to the top of the wellhead. Throughout the present disclosure, the terms "casing," "well casing," and "casing string" may be used interchangeably to refer to pipe inserted into the seabed to drill and construct a well. Casings 18 are typically cemented in place and serve a variety of well-known purposes during the life cycle of a subsea well. Multiple casings 18 are typically inserted into the wellbore during well construction, beginning with the largest diameter or outermost diameter casing $\mathbf{18}_o$, also known as the structural casing, or conductor. Casings having incrementally smaller diameters are subsequently inserted into the largest diameter casing, also referred to herein as the "conductor" $\mathbf{18}_o$ In one illustrative example, a 30 inch diameter conductor $\mathbf{18}_o$ can be first inserted into the seabed 1 by drilling or pile driving, followed by a 20 inch diameter casing $\mathbf{18}_{o-1}$, a 13⅜ inch diameter casing $\mathbf{18}_{i+1}$ and a 9⅝ inch diameter casing $\mathbf{18}_i$ (the innermost diameter casing), so that the four concentric casings 18 are cemented in place forming the wellbore, each successively going deeper below the seabed surface 1.

A wellhead 8 is connected to the top of the multiple casings 18, typically above the seabed surface 1 (i.e. the "mudline"), but sometimes at the seabed surface or even below the surface in an excavation known as a "glory hole." In one illustrative example, the wellhead 8 has a low-pressure wellhead housing 8A attached to the 30 inch diameter casing $\mathbf{18}_o$ and a high-pressure wellhead housing 8B attached to the 20 inch diameter casing $\mathbf{18}_{o-1}$. Additional equipment can be connected to the top of the wellhead. For instance, such additional equipment can include, but is not limited to, a blowout preventer 9 and associated equipment, a subsea tree and/or a shut off system that may include shut off valves. Other equipment can be present as would be appreciated by those of ordinary skill in the art.

Figure 2:
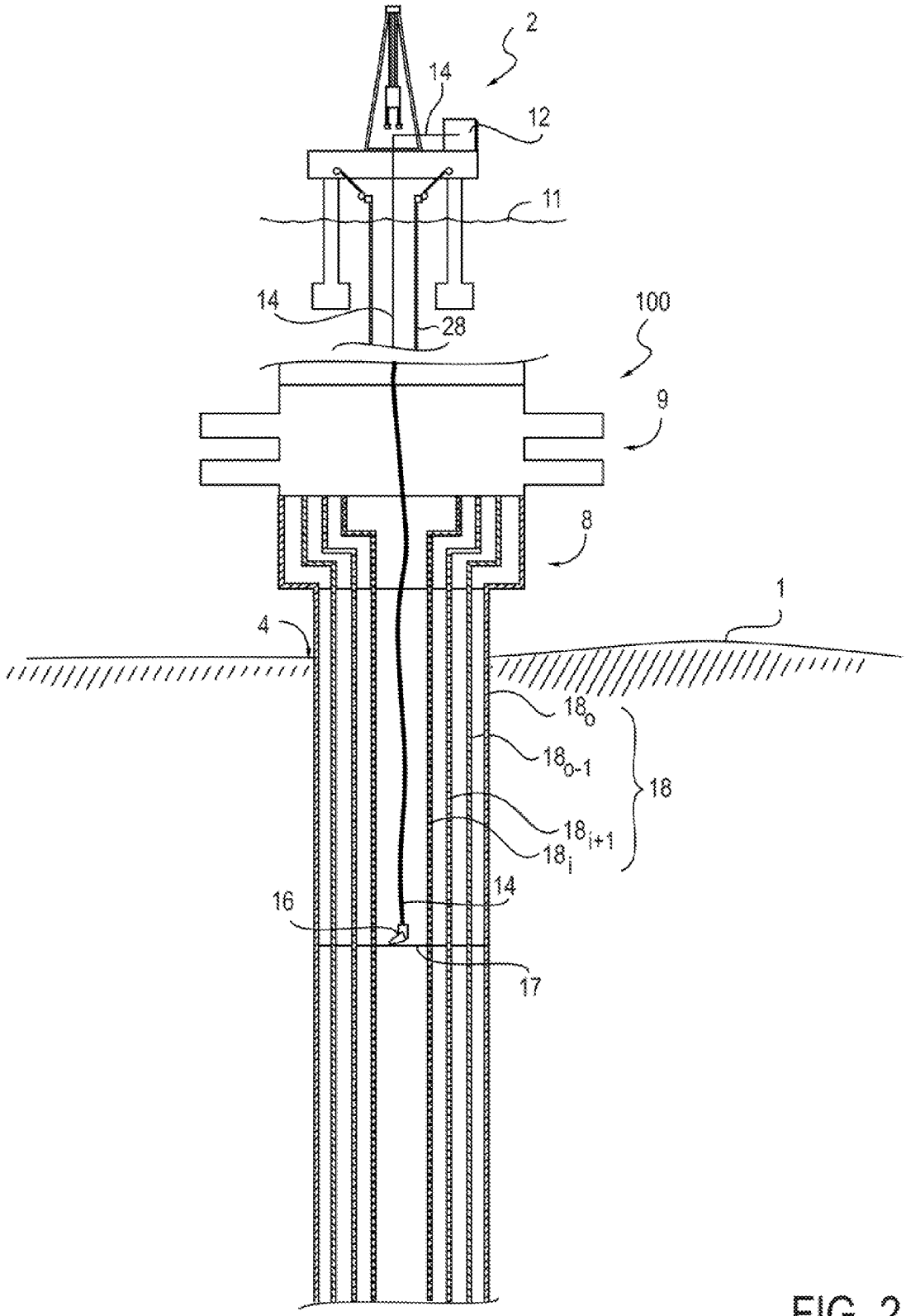
FIG. 2 illustrates a simplified system for removing individual portions of well casings and components according to one exemplary embodiment.

A system 100 and methods for removing components of the subsea well will now be described in more detail. As shown in FIG. 2, the system 100 includes a floating vessel 2. As used herein, "floating vessel" refers to any structure generally located in or on a body of water that can be located generally above or near the subsea well, including, but not limited to, a drill ship, an intervention vessel, a tension leg platform (TLP), a semi-submersible platform, and a jack-up rig. Because the floating vessel 2 moves on the surface of the water 11, and the subsea well 4 and wellhead 8 are fixed in the seabed 1, provision can be made to allow the floating vessel 2 to move relative to the wellhead 8. In response to this movement, the BOP 9 is placed on the seabed 1 in case the rig 2 accidentally moves beyond its operating envelope area. This allows the BOP 9 to remain in position atop the wellhead and seal and isolate the well from the environment pending the floating vessel's return.

The multiple casings 18 and the wellhead 8 can be severed and raised together on to the floating vessel 2 in one operation using methods described herein. The system 100 utilizes a cutting mechanism for cutting through the multiple casings 18 in a single operation. The cutting mechanism includes an actuator 12 located on the floating vessel 2. A utility line 14 is connected to the actuator 12 at an upper end and to a cutting tool 16 at a lower end.

In one embodiment, a method for removing components of the subsea well 4 includes lowering the utility line 14 and cutting tool 16 from the floating vessel 2 while the utility line is connected to the actuator 12 until the cutting tool 16 is positioned at a predetermined cut location in the subsea well 4 at a depth below the seabed 1. The cutting tool 16 severs the multiple well casings 18 completely and concurrently in one operation below the seabed surface, utilizing an energy source either in the tool 16 or on the floating vessel 2. Once the multiple well casings 18 are severed, two separate bodies are formed, one including the well casings to be abandoned below the cut 17, and one including the severed well casings and wellhead to be retrieved above the cut 17. The utility line 14 and the cutting tool 16 are retrieved to the floating vessel 2. The wellhead 8 and the severed multiple well casings 18 can then be raised together from the seabed to the floating vessel 2 as a single severed assembly.

Figure 3:
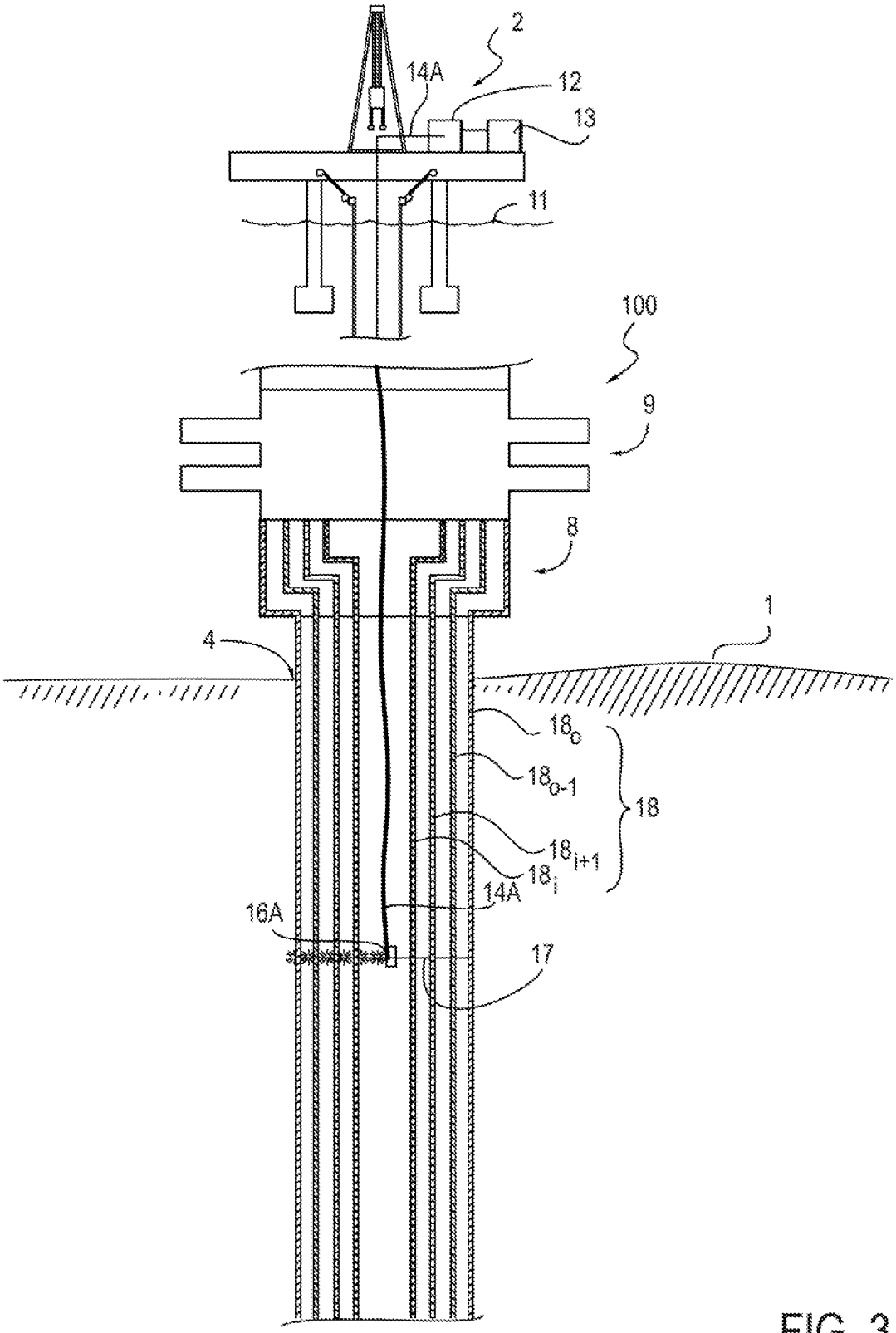
FIG. 3 illustrates a system according to one exemplary embodiment utilizing a laser cutting tool.

The cutting tool 16 of the cutting mechanism can take any of a variety of forms. In one embodiment, as shown in FIG. 3, the cutting tool 16 is a laser cutting tool 16A utilizing a laser to cut the multiple well casings 18. In this embodiment, the actuator 12 is connected to a laser generator 13 located on the floating vessel 2. Other associated equipment and consumables needed to support the laser cutting tool will be present. Such equipment and consumables can include deployment and retrieval systems, control, cooling and purging liquids and gases, control power, actuating power, sensor, control and feedback signals, etc. The utility line 14A for this embodiment will include a fiber-optic cable for delivering the laser from the laser generator 13 to the laser cutting tool 16A. The utility line 14A can optionally include other components such as one or more power cables, one or more control cables, one or more liquid or gas conduit or tubing strings, and the like. The components of the utility line 14A may be provided within an umbilical, coiled tubing, jointed pipe, jointed tubing or the like.

Figure 4:
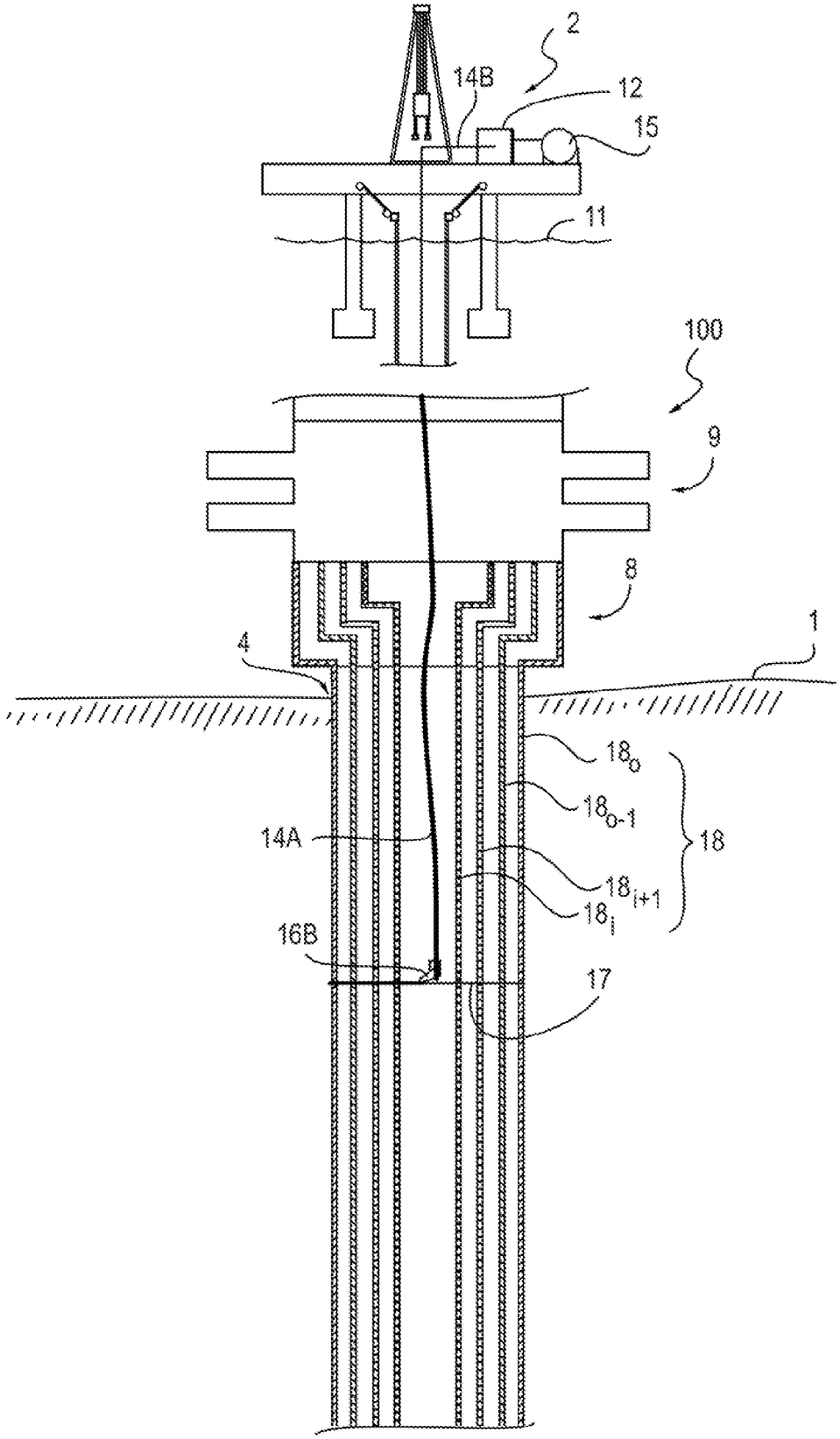
FIG. 4 illustrates a system according to one exemplary embodiment utilizing a waterj et cutter.

In one embodiment, as shown in FIG. 4, the cutting tool is a water jet cutter 16B utilizing a high-pressure jet of water to cut the multiple well casings 18. The high-pressure jet of water can include an abrasive material. The utility line 14 for this embodiment will include a water line 14B and the actuator 12 is connected to a high-pressure water pump 15. The utility line 14B can optionally include other components such as one or more power cables, one or more control cables, and the like. Again, the components of the utility line 14B may be provided within an umbilical, coiled tubing, jointed pipe, jointed tubing or the like.

In one embodiment, not shown, the cutting tool 16 can be one or more directionally controlled explosives or shaped charges, e.g. fast-burning pyrotechnic shaped charges. The cutting tool 16 is capable of generating a plasma that can sever the multiple well casings 18.

In one embodiment, not shown, the cutting tool is a chemical cutter 16. The chemical cutter 16 directs chemicals capable of dissolving steel from a reservoir inside the tool 16, through openings in the tool and into contact with the multiple casings 18 to be cut where the chemicals can dissolve the multiple casings 18 and effect a cut there through. Once the cutting tool 16 is positioned in the predetermined cut location within the multiple well casings 18, the cutting equipment or mechanism 16 can be directed outwards towards the innermost well casing to cut the multiple casings 18. In one embodiment, the multiple well casings 18 are severed, i.e., completely disconnected at the cut location, forming the cut 17.

In one embodiment, the multiple well casings 18 are severed in a single round trip. By "single round trip" is meant one occurrence of running the cutting tool 16 into and out of the well 4 from the floating vessel 2.

Figure 5:
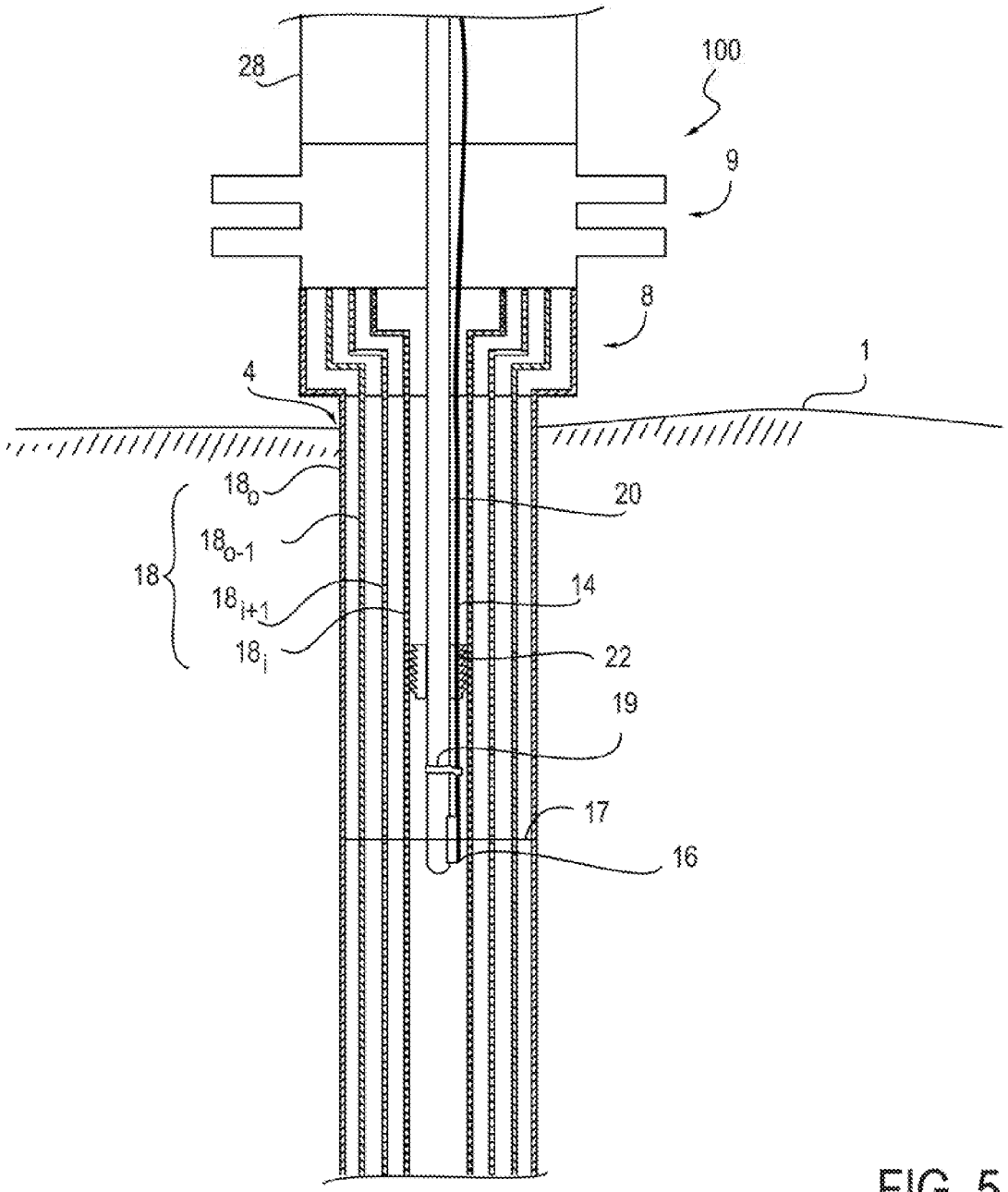
FIG. 5 illustrates a system according to one exemplary embodiment utilizing an elongated tensile element to assist in lowering the cutting tool.

In one embodiment, as shown in FIG. 5, the system 100 includes an elongated tensile element 20 capable of being reversibly connected to the utility line 14 for being lowered together from the floating vessel 2 to the predetermined cut location. For instance, the utility line 14 can be temporarily strapped onto the elongated tensile element 20 using a strap 19. The elongated tensile element 20 can take a variety of forms, including, but not limited to, drill pipe, solid rod, flexible composite material, wire rope, electrical wire line, coiled tubing, tubing, casing, line pipe, flexible umbilical, steel rod and the like. In one embodiment, lengths of drill pipe, also known as "joints," are connected, e.g., by screwing them together to form the elongated tensile element 20. The elongated tensile element 20 has a tensile strength sufficient to carry the utility line 14 and the cutting tool 16 in tension, i.e., the elongated element 20 is strong enough to lower and lift the utility line 14 and the cutting tool 16 together into and out of the floating vessel 2. Riser 28 may or may not be present. In one embodiment, the utility line 14 and cutting tool 16 are reversibly connected to the elongated tensile element 20.

In one embodiment, the elongated tensile element 20 includes a spear grapple 22 capable of engaging an internal surface of the multiple well casings 18. The spear grapple 22 expands to hold the interior of the well casings 18 as would be appreciated by one of ordinary skill in the art. In this case, the elongated tensile element 20 with the spear grapple 22 has a tensile strength sufficient to carry the utility line 14, the cutting tool 16, the wellhead 8 and the multiple well casings 18 in tension so that the utility line 14, cutting tool 16, wellhead 8 and severed multiple casings 18 can be raised together from the well location to the floating vessel 2 using the elongated tensile element 20 with spear grapple 22.

Figure 6:
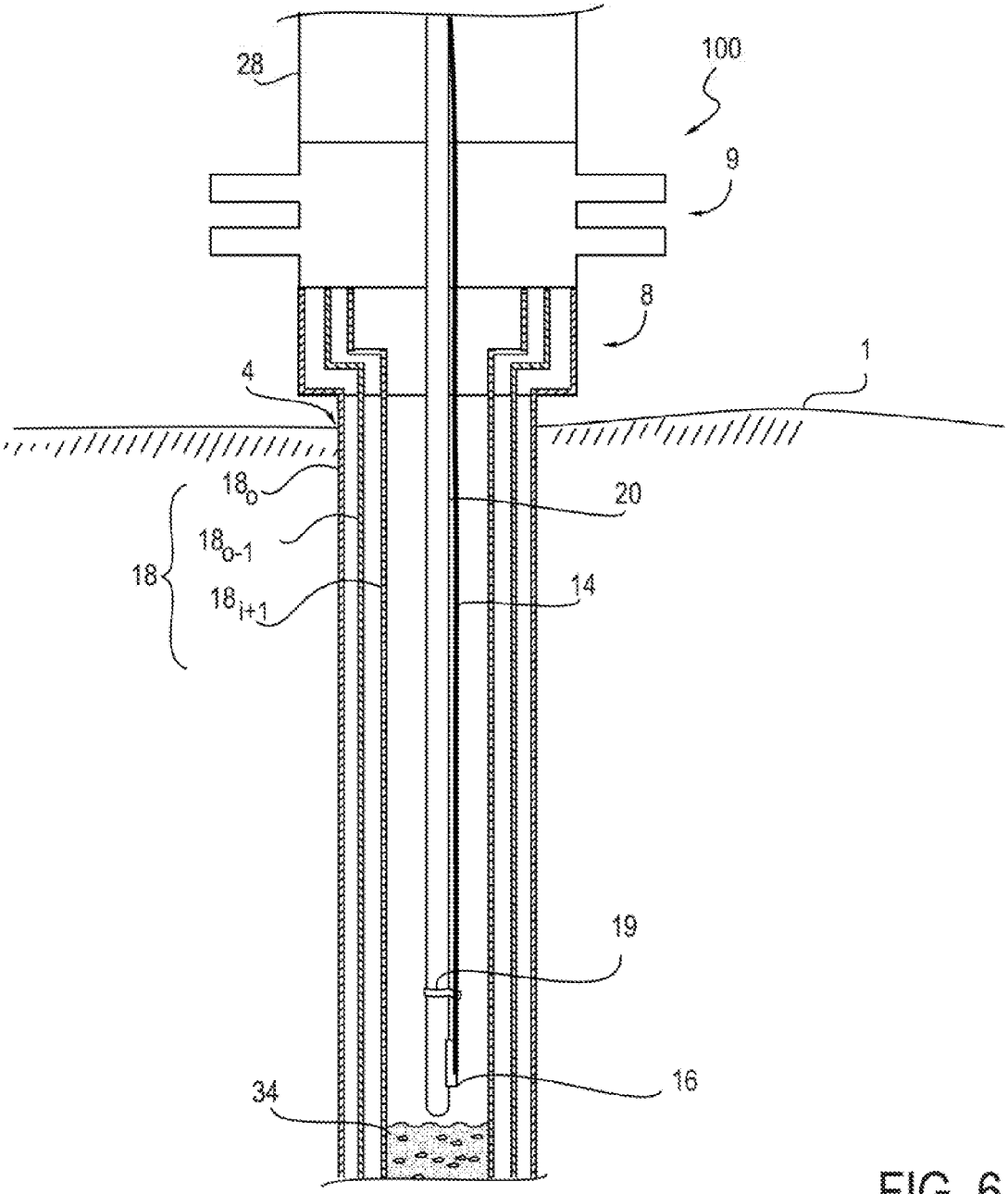
FIG. 6 illustrates a system according to one exemplary embodiment utilizing an elongated tensile element to dispense cement into a well following well casing removal.

In one embodiment, as shown in FIG. 6, the elongated tensile element 20 can further be used to dispense cement (supplied from a cement source not shown) into the well after a casing is removed to form a plug 34. This is advantageous as the single elongated tensile element 20 can be used for multiple functions, i.e., to position the cutting tool 16, raise the well casings 18 and deliver the cement to form the plug 34.

Figure 7:
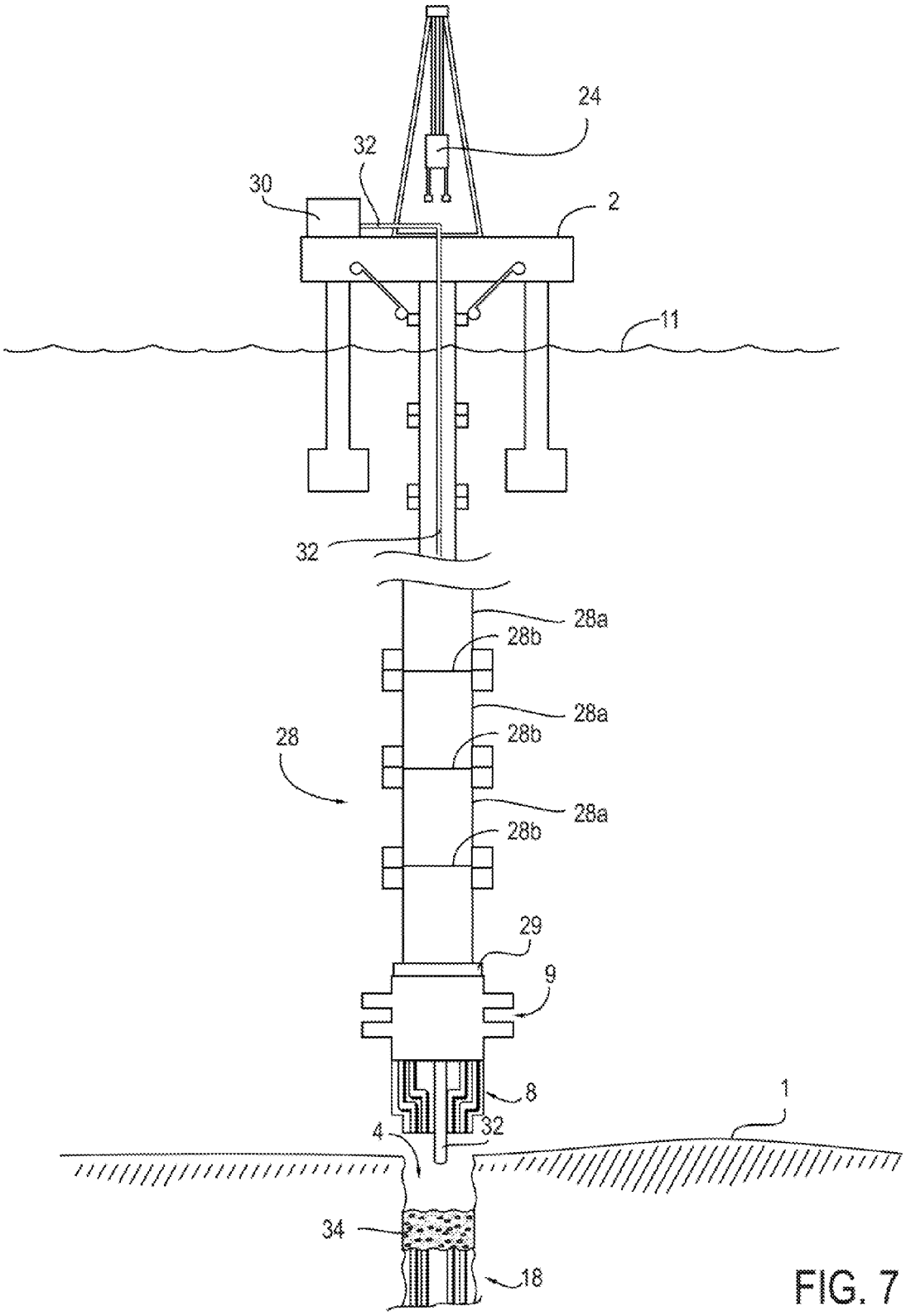
FIG. 7 illustrates a system according to one exemplary embodiment utilizing a conduit and a lifting mechanism.

In one embodiment, as shown in FIG. 7, the system 100 includes a conduit 28 (also referred to as a riser, marine drilling riser or marine riser) that has a lower end capable of being connected to the wellhead 8. Suitable conduits can include risers, flexible risers and segmented jointed pipe. The utility line 14 and the cutting tool 16 can be lowered from the floating vessel 2 to the subsea well through the conduit 28. In one embodiment, a lifting mechanism 24 located on the floating vessel 2 is capable of lowering and lifting well components and the conduit 28. Suitable lifting mechanisms 24 can include a block and tackle, a drawworks, a hydraulic lift, a pneumatic lift, an A-frame, a crane, and combinations thereof. The conduit 28 is deployable from the floating vessel 2 to the subsea well 4. In one embodiment, the conduit can be deployed from the floating vessel through a moon pool (not shown) in the floating vessel. Alternatively, the conduit 28 can be deployed from the floating vessel 2 over the side of the floating vessel (not shown). In one embodiment, the lower end of the conduit is connectable to the wellhead 8 using a collet connector 29 such as those actuated by hydraulic fluid or any alternative methods known to those of ordinary skill in the art. The conduit 28 has a tensile strength sufficient to carry the wellhead 8 and the multiple well casings 18 in tension.

According to one method, the lifting mechanism 24 is used to lower the conduit 28 from the floating vessel 2 such that the conduit 28 is positioned generally vertically over the subsea well 4. The lower end of the conduit 28 is then connected to the wellhead 8 using any suitable means. At this point, the utility line 14 and cutting tool 16 can be lowered to the predetermined cut location as described above through the conduit 28. The severing cut can be made through the multiple casings 18. The utility line 14 and cutting tool 16 are then retrieved back up to the floating vessel 2 through the conduit 28. At this point, the lifting mechanism 24 is used to raise the conduit 28 while still connected to the wellhead 8 and the severed multiple casings 18. In this way, all of the wellhead 8 and severed casings 18 can be raised concurrently to the floating vessel 2. In some embodiments, the utility line 14 and cutting tool 16 can be lowered and retrieved through the conduit 28 using the lifting mechanism 24.

In some embodiments, additional equipment connected to the wellhead 8 may be present. Such additional equipment can include, but is not limited to, a blowout preventer 9 and associated equipment, a subsea tree and/or a shut off system that may include shut off valves. In this case, the lower end of the conduit 28 is connected to the wellhead by way of the additional equipment connected to the wellhead 8. In other words, the lower end of the conduit 28 is connected to whatever additional equipment is present. In such case, the additional equipment is raised together with the conduit 28, the wellhead 8 and the severed multiple well casings 18 to the floating vessel 2.

In some embodiments, it may be advantageous for the conduit 28 to be made up of a number of conduit segments 28*a* connected by conduit joints 28*b*. For example, this can be a known type of segmented joined pipe, e.g., having 50 foot segments. In this case, when the conduit 28, wellhead 8 and severed multiple well casings 18 are raised together to the floating vessel 2 as a single assembly, the assembly can then be disassembled by individually disconnecting and placing each uppermost conduit segment from the raised assembly on the floating vessel 2 until all of the conduit segments 28*a* have been disconnected and placed on the floating vessel 2. The conduit segments 28*a* can be stowed or secured. Prior to disconnecting each uppermost conduit segment from the raised assembly, the uppermost conduit segment is supported and the tension is released. What remains is a smaller assembly including the wellhead 8 connected to the severed multiple well casings 18. This smaller assembly can then be placed on the floating vessel 2.

In one embodiment, a cement source 30 is provided on the floating vessel 2, connected to a cement dispensing line 32 capable of being lowered to deliver cement to the subsea well 4, i.e. in the abandoned subsea well casing strings remaining below the seabed. By "cement" herein is meant any cement, resin or other material capable of plugging or isolating a wellbore. The cement dispensing line 32 can be a coiled tubing line or a jointed pipe, or any other suitable means for dispensing cement known to those of ordinary skill in the art. In one embodiment, as described above, a method includes lowering the utility line 14 and cutting tool 16 from the floating vessel 2 while the utility line is connected to the actuator 12 until the cutting tool 16 is positioned at a predetermined cut location in the subsea well 4 at a depth below the seabed 1. The cutting tool 16 severs the multiple well casings 18 completely and concurrently in one operation below the seabed surface. The utility line 14 and the cutting tool 16 are then retrieved to the floating vessel 2. The wellhead 8 and the severed multiple well casings 18 can then be raised together from the seabed to a predetermined height above the seabed 1 and the subsea well 4 as a single severed assembly. At this point, the cement dispensing line 32 is lowered until the lower end of the cement dispensing line 32 is positioned in the subsea well 4 at a desired location in the abandoned subsea well casing strings for dispensing cement. Cement is dispensed through the cement dispensing line 32 proximate the subsea well 4 sufficiently to form a cement plug 34 at or below the seabed 1. The cement dispensing line 32 can then be retrieved to the floating vessel 2. Finally, the wellhead 8 and the severed multiple well casings 18 can then be raised together from the predetermined height above the subsea well 4 to the floating vessel 2 as a single assembly. In this way, the well 4 can be efficiently plugged at the seabed 1 as the well components are removed.

Figure 8:
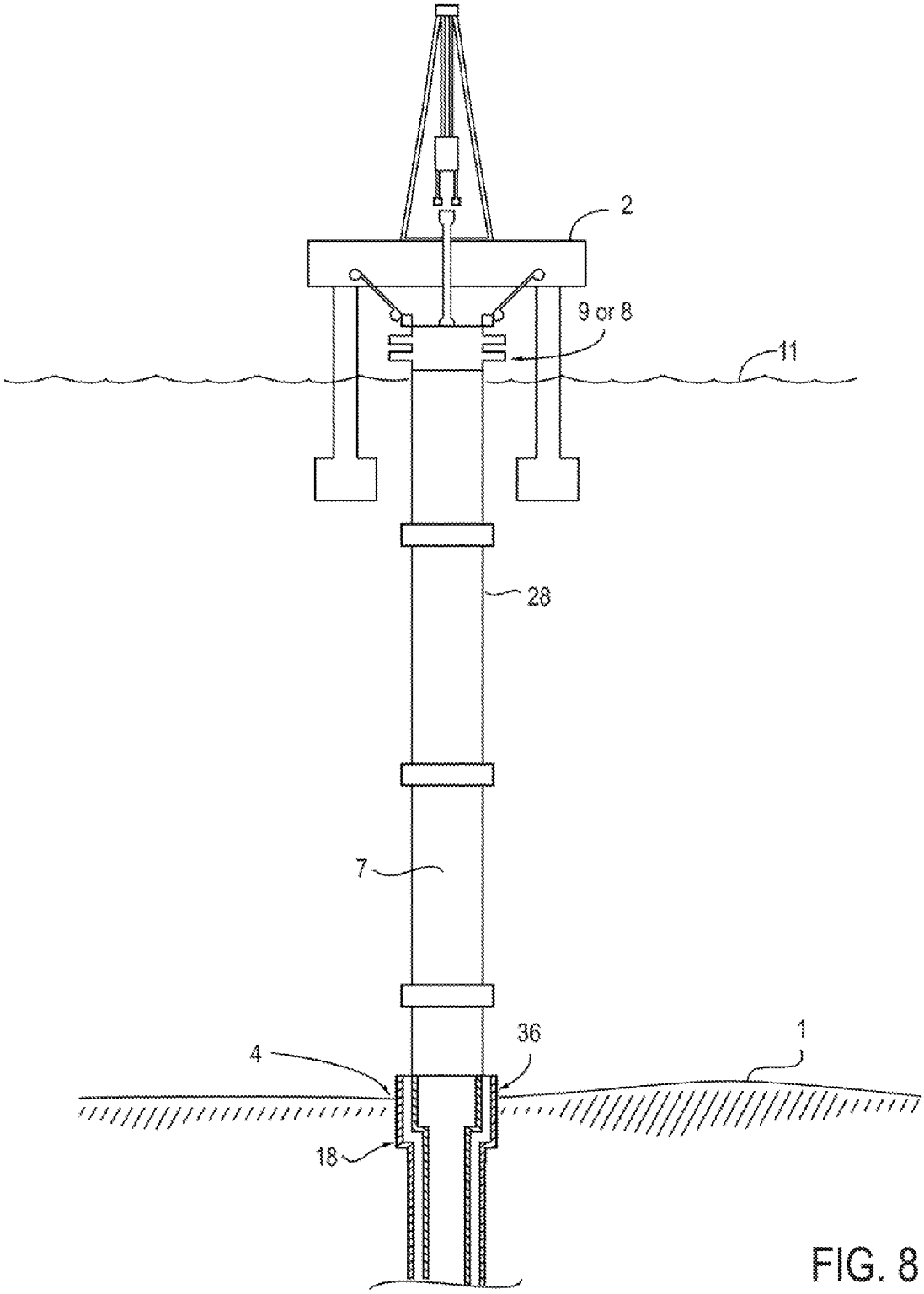
FIG. 8 illustrates a system according to one exemplary embodiment utilizing a mudline suspension system.

In one embodiment, as shown in FIG. 8, the system can include a mudline suspension system (MLSS) 36 located subsea at the mudline 1. This can be done for various reasons, e.g. to suspend the weight of the casing strings 18 at the mudline, rather than on the platform itself. The individual casing strings are landed in the MLSS 36 at the seafloor, then the well is connected back to the platform and BOPs 9 at the surface through a rigid conductor and production casing 28. The wellhead 8 and/or BOPs 9 can be located at the surface, above the water, because the host platform, facility, or rig 2 is fixed and cannot move off of its location above the well and the relative motion of the vessel to the well, if any, is very slight. In this case, for abandonment, the BOPs 9 are removed separately, since they are located immediately below the rig floor and must be moved out of the way before any other operation takes place. The MLSS 36 operational sequence of events is essentially the same as a subsea operational sequence of events would be once the riser has been recovered, with the BOPs 9 now located directly below the rig floor.

Figure 9:
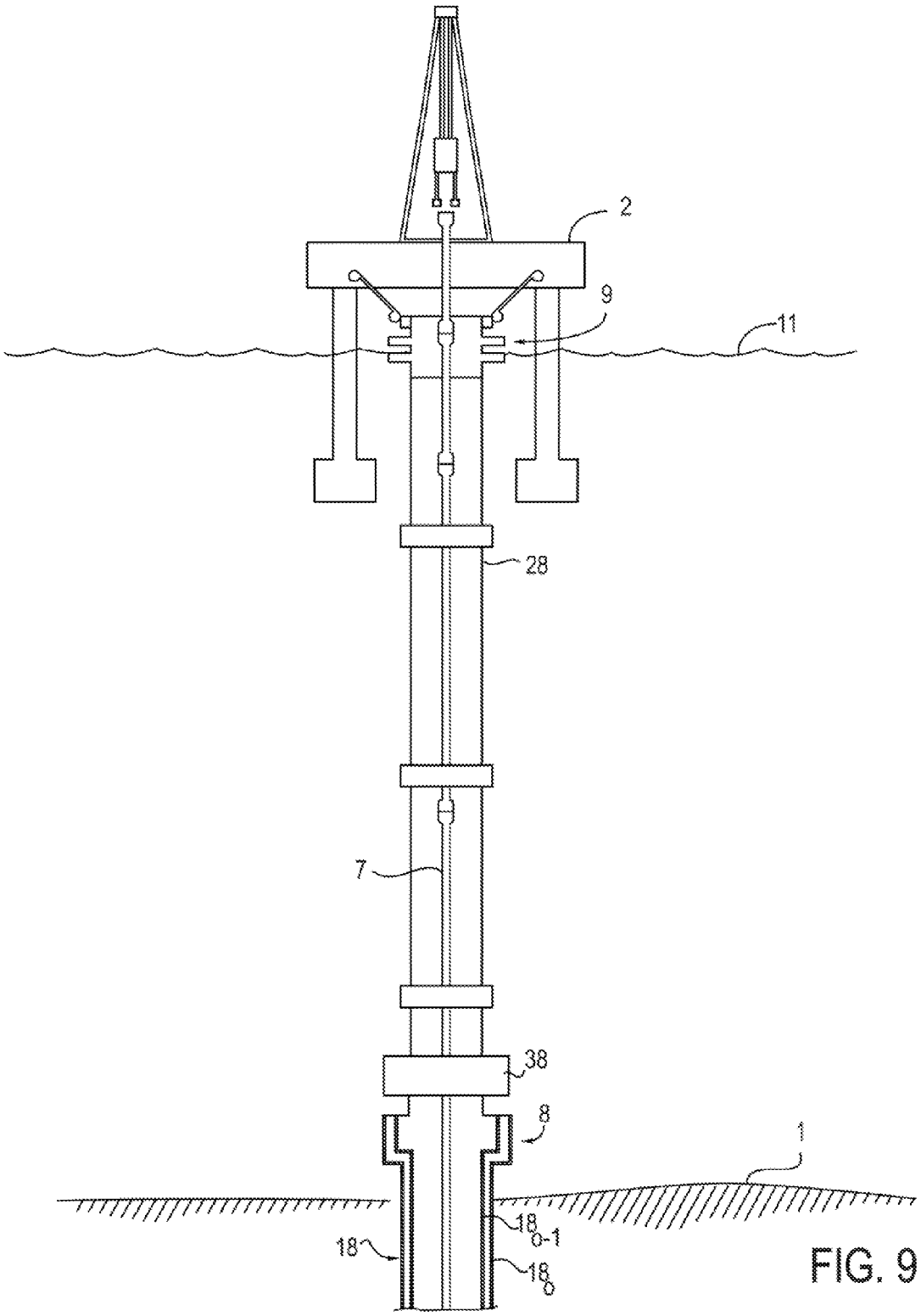
FIG. 9 illustrates a system according to one exemplary embodiment utilizing a mudline closure device.

In one embodiment, as shown in FIG. 9, the system can include a surface BOP stack 9 on top of a fixed, semi-rigid conductor casing 28 terminating at a subsea wellhead 8, with a Mudline Closure Device (MCD) system 38 located immediately above the seabed 1. This embodiment would be recovered operationally in a manner very similar to the MLSS 36 mentioned above, the exception being that the subsea wellhead 8 would replace the MLSS 36 and the MCD 38 would be in place above the subsea wellhead 8. Like the MLSS procedure, the surface BOPs 9 would first be removed and moved out of the way, then the conductor 28 would be recovered with the MCD 38, subsea wellhead 8 and severed casings 18 below that.

In some embodiments, it may be advantageous for multiple wells to be arranged with the use of structural templates on the seabed. In such cases, multiple wellheads 8 and sets of multiple well casings 18 can be connected to each other via the frame of the template. The multiple wellheads 8 and sets of multiple well casings 18 (and optional additional equipment) can in some cases be removed using the systems and methods disclosed herein such that the multiple wellheads 8 and sets of multiple well casings 18 are raised as one assembly with the structural template.

According to embodiments disclosed herein, components of a subsea well can be removed using a method that is significantly simpler, safer, faster, less costly and more efficient than known methods.

It should be noted that only the components relevant to the disclosure are shown in the figures, and that many other components normally part of a system for retrieving components of a subsea well, for abandoning and or plugging a subsea well or of the subsea well itself are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A method for removing components of a subsea well comprising a wellhead located on a seabed and multiple well casings connected to the wellhead and penetrating the seabed wherein the wellhead is connected to a blow-out preventer, comprising:

a. lowering a utility line from a floating vessel wherein the utility line has an upper end connected to an actuator on the floating vessel and a lower end connected to a cutting tool and wherein the utility line is lowered through the blow-out preventer until the cutting tool is positioned at a predetermined cut location in the subsea well;

b. severing the multiple well casings using the cutting tool at the predetermined cut location such that the multiple well casings are completely severed concurrently;

c. retrieving the utility line and the cutting tool through the blow-out preventer to the floating vessel; and d. raising the blow-out preventer, the wellhead and the severed multiple well casings together from the seabed to the floating vessel as a single assembly.

2. The method of claim 1, wherein the utility line is reversibly connected to an elongated tensile element and the utility line and elongated tensile element are lowered together in step (a).

3. The method of claim 2, wherein the elongated tensile element comprises a spear grapple and further comprising engaging the spear grapple to raise the blow-out preventer, the wellhead and the severed multiple well casings together to the floating vessel in step (d).

4. The method of claim 1, wherein the floating vessel has a lifting mechanism thereon capable of lowering and lifting well components and further comprising, prior to lowering the utility line from the floating vessel in step (a):

lowering a conduit having an upper end and a lower end from the floating vessel using the lifting mechanism such that the conduit is positioned generally vertically over the blow-out preventer; and connecting the lower end of the conduit to the blow-out preventer;

wherein the utility line and the cutting tool are lowered through the conduit and the blow-out preventer into the subsea well to make the severing cut in step (b); the utility line and the cutting tool are retrieved through the blow-out preventer and the conduit to the floating vessel in step (c); and the conduit, the blow-out preventer, the wellhead and the severed multiple well casings are raised together to the floating vessel in step (d).

5. The method of claim 4, wherein the conduit comprises a plurality of conduit segments connected by conduit joints.

6. The method of claim 5, further comprising:

individually disconnecting and placing each uppermost conduit segment of the plurality of conduit segments from the raised conduit, blow-out preventer, wellhead and severed multiple well casings on the floating vessel until all of the plurality of conduit segments have been disconnected and placed on the floating vessel;

disconnecting the blow-out preventer from the wellhead and severed multiple well casings and placing the disconnected blow-out preventer on the floating vessel; and placing an assembly comprising the wellhead and the severed multiple well casings on the floating vessel.

7. The method of claim 1, wherein the utility line comprises one or more of an umbilical, coiled tubing, jointed pipe, jointed tubing and a cable.

8. The method of claim 1, wherein the multiple well casings are severed in a single rotational pass of the cutting tool.

9. The method of claim 1, wherein the multiple well casings are severed in a single round trip.

10. The method of claim 1, wherein the cutting tool comprises a laser cutting tool utilizing a laser.

11. The method of claim 10, wherein the cutting mechanism further comprises a laser generator on the floating vessel.

12. The method of claim 10, wherein the utility line comprises an umbilical comprising a fiber-optic cable for delivering the laser to the laser cutting tool.

13. The method of claim 1, wherein the cutting tool comprises a water jet cutter utilizing a high-pressure jet of water.

14. The method of claim 13, wherein the high-pressure jet of water further comprises an abrasive material.

15. The method of claim 13, wherein the utility line comprises a water line and the cutting mechanism further comprises a high-pressure water pump on the floating vessel.

16. The method of claim 1, wherein the cutting tool comprises a directionally controlled explosive or a shaped charge capable of generating a plasma capable of severing the multiple well casings.

17. The method of claim 1, wherein the cutting tool comprises a chemical cutter comprising a reservoir for containing chemicals capable of dissolving steel and openings in communication with the reservoir through which the chemicals can be directed onto the multiple well casings at the predetermined cut location to sever the multiple well casings.

18. A method for removing components of a subsea well comprising a wellhead located on a seabed and multiple well casings connected to the wellhead and penetrating the seabed wherein the wellhead is connected to a blow-out preventer, comprising:

a. lowering a utility line from a floating vessel wherein the utility line has an upper end connected to an actuator on the floating vessel and a lower end connected to a cutting tool wherein the utility line is lowered through the blow-out preventer until the cutting tool is positioned at a predetermined cut location in the subsea well;

b. severing the multiple well casings using the cutting tool at the predetermined cut location such that the multiple well casings are completely severed concurrently to form abandoned subsea well casing strings below the cut location and severed subsea well casing strings, wellhead and blow-out preventer above the cut location;

c. retrieving the utility line and the cutting tool through the blow-out preventer to the floating vessel;

d. raising the severed subsea well casing strings, the wellhead and the blow-out preventer together from the seabed to a predetermined height above the seabed and above the abandoned subsea well casing strings as a single assembly;

e. lowering a cement dispensing line having an upper end connected to a cement source on the floating vessel and a lower end for dispensing cement from the floating vessel until the lower end of the cement dispensing line is positioned in the abandoned subsea well casing strings;

f. dispensing cement through the cement dispensing line proximate the abandoned subsea well casing strings sufficiently to form a cement plug at or below the seabed;

g. retrieving the cement dispensing line to the floating vessel; and h. raising the severed subsea well casing strings, the wellhead and the blow-out preventer together from the predetermined height above the seabed and above the abandoned subsea well casing strings to the floating vessel as a single assembly.

19. The method of claim 18, wherein the cement dispensing line is selected from a coiled tubing line and a jointed pipe.

20. A system for removing components of a subsea well comprising a wellhead located on a seabed and multiple well casings connected to the wellhead and penetrating the seabed wherein the wellhead is connected to a blow-out preventer, comprising:

a. a floating vessel; and b. a cutting mechanism comprising:

i. an actuator on the floating vessel;

ii. a utility line having an upper end connected to the actuator and a lower end; and iii. a cutting tool connected to the lower end of the utility line capable of severing the multiple well casings, wherein the utility line and cutting tool are capable of being lowered through the blow-out preventer from the floating vessel until the cutting tool is positioned at a predetermined cut location in the subsea well at a depth below the seabed;

wherein the blow-out preventer, the wellhead and the severed multiple well casings are capable of being lifted from the seabed to the floating vessel as a single assembly.

21. The system of claim 20, further comprising an elongated tensile element capable of being reversibly connected to the utility line for lowering together from the floating vessel to the predetermined cut location.

22. The system of claim 21, wherein the elongated tensile element comprises a spear grapple capable of engaging an internal surface of the multiple well casings wherein the elongated tensile element has a tensile strength sufficient to carry the utility line, the cutting tool, the blow-out preventer, the wellhead and the severed multiple well casings in tension to the floating vessel.

23. The system of claim 20, further comprising a lifting mechanism located on the floating vessel capable of lowering and lifting well components and a conduit deployable from the floating vessel to the subsea well location;

wherein the utility line and cutting tool are capable of being lowered from the floating vessel to the predetermined cut location in the subsea well through the conduit and blow-out preventer; and wherein the conduit has a lower end capable of being connected to the blow-out preventer and has a tensile strength sufficient to carry the blow-out preventer, the wellhead and the severed multiple casings in tension.

24. The system of claim 23, wherein the lifting mechanism is selected from a block and tackle, a drawworks, a hydraulic lift, a pneumatic lift, an A-frame and a crane.

25. The system of claim 20, further comprising a cement source on the floating vessel; and a cement dispensing line connected to the cement source capable of being lowered from the floating vessel to deliver cement to abandoned subsea well casing strings at the subsea well location.

26. The system of claim 20, wherein the cutting tool comprises a laser cutting tool utilizing a laser.

27. The system of claim 26, wherein the cutting mechanism further comprises a laser generator on the floating vessel.

28. The system of claim 26, wherein the utility line comprises an umbilical comprising a fiber-optic cable for delivering the laser to the laser cutting tool.

29. The system of claim 20, wherein the cutting tool comprises a water jet cutter utilizing a high-pressure jet of water.

30. The system of claim 29, wherein the high-pressure jet of water further comprises an abrasive material.

31. The system of claim 29, wherein the utility line comprises a water line and the cutting mechanism further comprises a high-pressure water pump on the floating vessel.

32. The system of claim 20, wherein the utility line comprises one or more of an umbilical, coiled tubing, jointed pipe, jointed tubing and a cable.

33. The system of claim 20, wherein the cutting tool comprises a directionally controlled explosive or a shaped charge capable of generating a plasma capable of severing the multiple well casings.

34. The system of claim 20, wherein the cutting tool comprises a reservoir for containing chemicals capable of dissolving steel and openings through which the chemicals can be directed onto the multiple well casings at the predetermined cut location to sever the multiple well casings.

35. A system for removing components of a subsea well comprising a mudline suspension system located on a seabed and multiple well casings connected to the mudline suspension system and penetrating the seabed wherein the mudline suspension system is connected to a conduit, wherein the conduit is in turn connected to a wellhead in turn connected to a blowout preventer, wherein the wellhead and the blowout preventer are located on the floating vessel, comprising:

a. a cutting mechanism comprising:

i. an actuator on the floating vessel;

ii. a utility line having an upper end connected to the actuator and a lower end; and iii. a cutting tool connected to the lower end of the utility line capable of severing the multiple well casings, wherein the utility line and cutting tool are capable of being lowered through the blow-out preventer, wellhead, conduit and mudline suspension system from the floating vessel until the cutting tool is positioned at a predetermined cut location in the subsea well at a depth below the seabed; and b. a lifting mechanism located on the floating vessel capable of lowering and lifting the blowout preventer, the wellhead, the conduit, the mudline suspension system, and the severed multiple casings;

wherein the conduit has a tensile strength sufficient to carry the mudline suspension system and the severed multiple casings in tension from the seabed to the floating vessel as a single assembly.

36. A system for removing components of a subsea well comprising a mudline closure device located on a seabed connected to a wellhead connected in turn to multiple well casings penetrating the seabed, wherein the mudline closure device is connected to a conduit in turn connected to a blow-out preventer on a floating vessel, comprising:

a. a cutting mechanism comprising:

i. an actuator on the floating vessel;

ii. a utility line having an upper end connected to the actuator and a lower end; and iii. a cutting tool connected to the lower end of the utility line capable of severing the multiple well casings, wherein the utility line and cutting tool are capable of being lowered through the blow-out preventer, conduit and mudline closure device from the floating vessel until the cutting tool is positioned at a predetermined cut location in the subsea well at a depth below the seabed; and b. a lifting mechanism located on the floating vessel capable of lowering and lifting the blow-out preventer, the conduit, the mudline closure device, the wellhead and the severed multiple casings;

wherein the conduit has a tensile strength sufficient to carry the mudline closure device, the wellhead and the severed multiple casings in tension from the seabed to the floating vessel as a single assembly.

* * * * *